US008577230B2

(12) United States Patent
Yamashina

(10) Patent No.: US 8,577,230 B2
(45) Date of Patent: Nov. 5, 2013

(54) FIXING DEVICE, FIXING DEVICE CONTROL METHOD, AND IMAGE FORMING APPARATUS

(75) Inventor: Ryota Yamashina, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 117 days.

(21) Appl. No.: 13/365,767

(22) Filed: Feb. 3, 2012

(65) Prior Publication Data

US 2012/0201547 A1 Aug. 9, 2012

(30) Foreign Application Priority Data

Feb. 3, 2011 (JP) ..... 2011-021855

(51) Int. Cl.
*G03G 15/00* (2006.01)

(52) U.S. Cl.
USPC ..... 399/15; 399/49; 399/67; 399/68; 399/69

(58) Field of Classification Search
USPC ..... 399/15, 45, 49, 67, 68, 69
See application file for complete search history.

(56) References Cited

U.S. PATENT DOCUMENTS

| | | | | |
|---|---|---|---|---|
| 8,064,798 | B2 | 11/2011 | Shinshi et al. | |
| 8,135,296 | B2 * | 3/2012 | Nakane | 399/68 |
| 8,150,289 | B2 | 4/2012 | Yamashina et al. | |
| 8,160,484 | B2 | 4/2012 | Hasegawa et al. | |
| 2010/0061754 | A1 | 3/2010 | Ishigaya et al. | |
| 2011/0052224 | A1 | 3/2011 | Yamashina et al. | |
| 2011/0064437 | A1 | 3/2011 | Yamashina et al. | |
| 2011/0091226 | A1 | 4/2011 | Ishigaya et al. | |
| 2011/0182634 | A1 | 7/2011 | Ishigaya et al. | |
| 2011/0206402 | A1 | 8/2011 | Yamashina | |
| 2011/0217057 | A1 | 9/2011 | Yoshinaga et al. | |
| 2011/0222927 | A1 | 9/2011 | Yamashina | |
| 2012/0093532 | A1 | 4/2012 | Ishigaya et al. | |
| 2012/0093534 | A1 | 4/2012 | Waida et al. | |

FOREIGN PATENT DOCUMENTS

| | | |
|---|---|---|
| JP | 4-80771 | 3/1992 |
| JP | 11-265091 | 9/1999 |
| JP | 2002-340518 | 11/2002 |

(Continued)

OTHER PUBLICATIONS

"Electrophotography—Bases and Applications", The Imaging Society of Japan, Corona Publishing, Jun. 20, 1997, pp. 195-198 (with English translation).

(Continued)

*Primary Examiner* — Hoang Ngo
(74) *Attorney, Agent, or Firm* — Oblon, Spivak, McClelland, Maier & Neustadt, L.L.P.

(57) ABSTRACT

A fixing device includes a fixing unit, a shearing unit, a detection unit, and a controller. The fixing unit fixes a toner image in place on a printed surface of a recording medium. The shearing unit is disposed downstream from the fixing unit along the media conveyance path to at least partially shear toner from the fixed toner image, so as to create a shorn image area that exhibits a different image density than that of an intact, unshorn image area on the printed surface of the recording medium. The detection unit is disposed at least partially downstream from the shearing unit along the media conveyance path to measure the image densities of the shorn and unshorn image areas. The controller is operatively connected to the fixing unit and the detection unit to adjust one or more operational parameters according to a difference between the measured image densities.

20 Claims, 10 Drawing Sheets

(56) References Cited

FOREIGN PATENT DOCUMENTS

| | | |
|---|---|---|
| JP | 2003-98769 | 4/2003 |
| JP | 2005-128004 | 5/2005 |
| JP | 2005-201947 | 7/2005 |
| JP | 2007-4051 | 1/2007 |
| JP | 2009-25029 | 2/2009 |
| JP | 2009-115953 | 5/2009 |

OTHER PUBLICATIONS

"Electrophotography—Process and Simulation", The Imaging Society of Japan, Tokyo Denki University Press, Sep. 20, 2009, pp. 78-83 (with English translation).

* cited by examiner

FIXING DEVICE, FIXING DEVICE CONTROL METHOD, AND IMAGE FORMING APPARATUS

CROSS-REFERENCE TO RELATED APPLICATION

This patent application claims priority pursuant to 35 U.S.C. §119 to Japanese Patent Application No. 2011-021855 filed on Feb. 3, 2011, the entire disclosure of which is hereby incorporated by reference herein.

BACKGROUND OF THE INVENTION

1. Technical Field

The present invention relates to a fixing device, a fixing device control method, and an image forming apparatus, and more particularly, to a fixing device for fixing an image in place on a recording medium, and an image forming apparatus, such as a photocopier, facsimile machine, printer, plotter, or multifunctional machine incorporating several of those features.

2. Background Art

In image forming apparatuses, such as photocopiers, facsimile machines, printers, plotters, or multifunctional machines incorporating several of those imaging functions, an image is formed by transferring ink or toner onto a recording sheet such as a sheet of paper. The transferred, unfixed toner image may be subsequently subjected to a fixing process using a fixing device, which permanently fixes the toner image in place on the recording medium with heat and pressure.

Various types of fixing devices are employed in electrophotographic printers, some of which includes a fixing assembly formed of a pair of opposed rotary members, such as endless looped belts or cylindrical rollers.

For example, a roller-based fixing assembly comprises an internally heated roller paired with a parallel, opposed roller that presses against and co-rotates with the internally heated roller. On the other hand, a belt-based fixing assembly comprises a thermally conductive endless belt looped around multiple rollers, at least one of which is heated to conduct heat to the fuser belt, and another is paired with a parallel, opposed pressure roller. Of the two types of fixing assembly, the belt-based configuration is advantaged over its counterpart in terms of thermal efficiency, owing to the use of the thermally conductive belt which can be immediately heated to a desired operational temperature upon startup.

One important factor that determines imaging quality of a fixing device is the strength of adhesion with which a fixed toner image adheres to a recording medium, i.e., the interfacial bonding strength between the toner layer and the printed surface of the recording medium. Since electrophotographic fixing proceeds where toner fuses and penetrates into a substrate with heat and pressure, the toner adhesion strength is influenced by various operational parameters with which a fixing device is operated to fix a toner image onto a recording medium. Examples of such parameters include a heating temperature at which the toner image is heated, a pressure force applied to the recording medium during fixing, and a conveyance speed with which the recording medium is conveyed under heat and pressure.

In addition to those operational parameters, the toner adhesion strength is also influenced by various properties of a recording medium. Various types of recording media are commercially available for printing purposes, each of which has a specific thickness and surface texture, including a wide variety of paper products ranging from normal copy paper to expensive, specially coated bond paper, as well as resin-based material such as transparency film for use in overhead projectors. Accommodating different types of recording media in a fixing device, however, would result in unstable fixing performance due to variations in toner adhesion strength caused by variations in properties between the respective recording media.

Various control methods have been proposed to stabilize performance of a fixing process regardless of the type of recording medium in use.

One such method employs an optical sensor to measure the thickness of recording medium accommodated in a fixing device, and adjusts the heating temperature of the fixing process depending on the measured media thickness to control fixing performance.

Another method allows a user to specify the type of recording medium, such as whether it is smooth copy paper or rough paper, and adjusts the amount of heat and pressure applied to the recording medium depending on the user-specified media type, thereby stabilizing fixing performance Still another method adjusts an operational parameter using more specific, physical properties of a recording medium, such as surface smoothness, so as to obtain more reliable fixing performance than is possible with adjustment based on measured media thickness or user-specified media type.

Although effective for their intended purposes, the control methods described above have several drawbacks.

One drawback is the difficulty in acquiring sufficient property information of a recording medium, in particular, surface smoothness, which is precise and accurate enough to allow for effective control of the fixing process. Another drawback is that specifying various properties of a recording medium upon each replacement or renewal is burdensome and error-prone to a human operator, which can result in a significant failure of the fixing process due to a lack of correct, complete information of the recording medium in use.

Moreover, even where each specific piece of property information of a recording medium is properly provided, some variations in toner adhesion strength are occasionally inevitable. Such inevitability is due primarily, if not exclusively, to the fact that, in addition to the property information derived through detection or from user specification, there are several undefined or omitted factors, such as microscopic fiber structure of the recording medium and dispersion of toner over the printed surface, that need to be addressed to obtain good fixing performance.

To alleviate these drawbacks, one possible approach is to provide an allowance or extra amount of heat to be applied to the recording medium to prevent insufficient fixing of toner. Such an approach, however, can be unsatisfactory where the recording medium in use is extremely thick and requires more heat to process a toner image properly, resulting in cold offset of toner. Also, extra heat application can result in hot offset of toner as well as waste of power lost where an excessive, unnecessary amount of heat is applied to a thin recording medium that can be processed at a relatively low temperature.

In a further attempt to address the problem, a control method has been proposed for controlling operation in a thermal head printer. According to this method, the fixing device is provided with a mechanical stylus or probe which swingably moves over the surface of a recording medium before entering the fixing process. Operation of the fixing device is controlled based on the surface morphology of the recording medium, which is determined by piezoelectrically detecting vibrations of the swingable probe.

SUMMARY OF THE INVENTION

Exemplary aspects of the present invention are put forward in view of the above-described circumstances, and provide a novel fixing device.

In one exemplary embodiment, the fixing device includes a fixing unit, a shearing unit, a detection unit, and a controller. The fixing unit fixes a toner image in place on a printed surface of a recording medium by subjecting the medium to a heating temperature and a pressure force during conveyance at a conveyance speed along a media conveyance path. The shearing unit is disposed downstream from the fixing unit along the media conveyance path to at least partially shear toner from the fixed toner image, so as to create a shorn image area that exhibits a different image density than that of an intact, unshorn image area on the printed surface of the recording medium. The detection unit is disposed at least partially downstream from the shearing unit along the media conveyance path to measure the image densities of the shorn and unshorn image areas. The controller is operatively connected to the fixing unit and the detection unit to adjust one or more operational parameters, including at least one of the heating temperature, the pressure force, and the conveyance speed for processing the recording medium through the fixing unit, according to a difference between the measured image densities indicative of an adhesion strength of toner to the recording medium.

Other exemplary aspects of the present invention are put forward in view of the above-described circumstances, and provide a method for controlling a fixing device.

Still other exemplary aspects of the present invention are put forward in view of the above-described circumstances, and provide an image forming apparatus.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
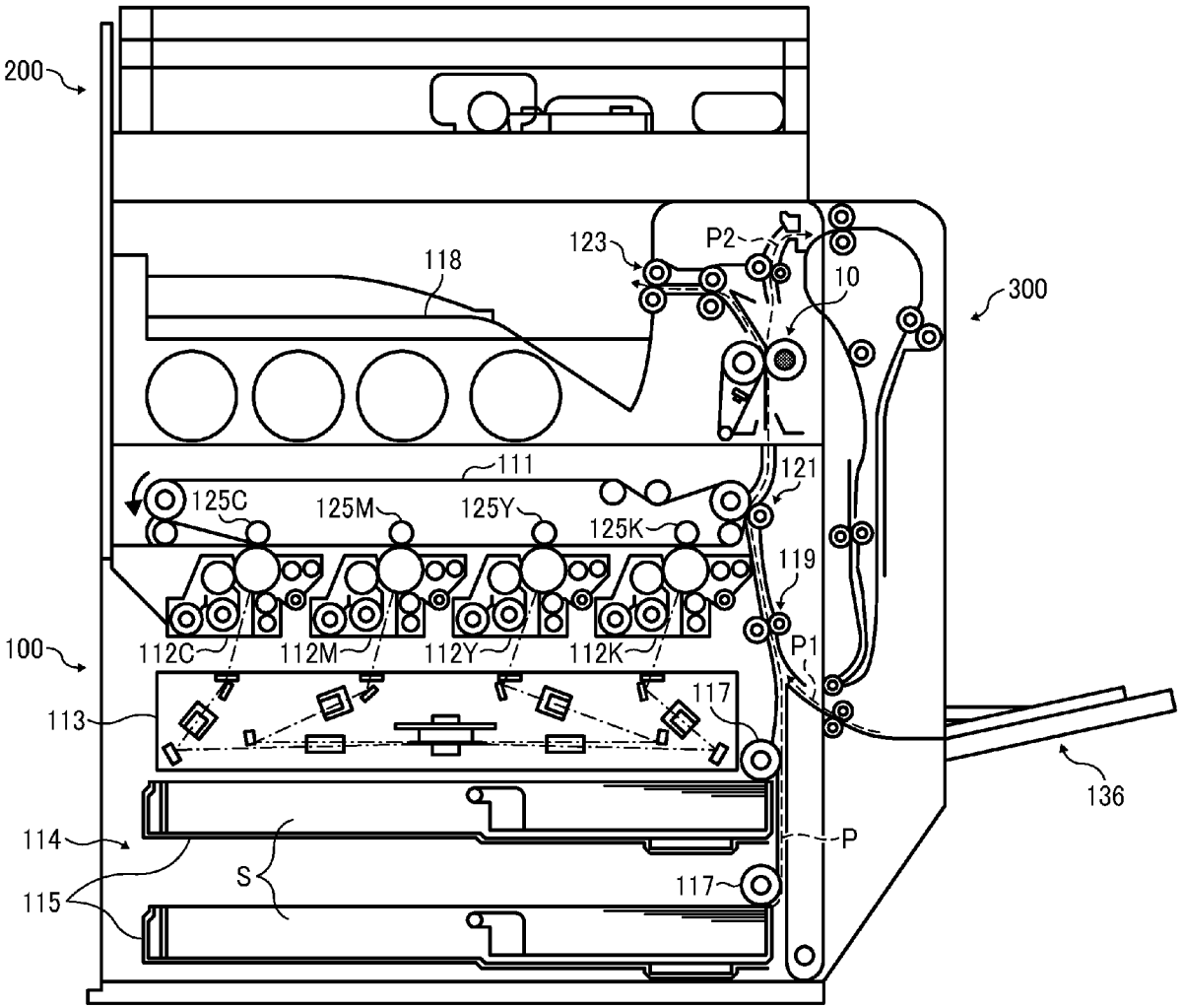
FIG. 1 schematically illustrates an image forming apparatus according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 incorporating a fixing device 10 according to this patent specification.

As shown in FIG. 1, the image forming apparatus 100 is a digital color imaging system that can print a color image on a recording medium such as a sheet of paper S according to image data, provided with an image scanner 200 located atop the apparatus body to capture image data from an original document, as well as a media reversal unit 300 attached to a side of the apparatus body to allow reversing a recording sheet S during duplex printing.

The image forming apparatus 100 comprises a tandem color printer that forms a color image by combining images of yellow, magenta, and cyan (i.e., the complements of three subtractive primary colors) as well as black, consisting of four electrophotographic imaging stations 112C, 112M, 112Y, and 112K arranged in series substantially laterally along the length of an intermediate transfer belt 111, each forming an image with toner particles of a particular primary color, as designated by the suffixes "C" for cyan, "M" for magenta, "Y" for yellow, and "K" for black.

Each imaging station 112 includes a drum-shaped photoconductor rotatable counterclockwise in the drawing, facing a laser exposure device 113 therebelow, while surrounded by various pieces of imaging equipment, such as a charging device, a development device, a transfer device incorporating an electrically biased, primary transfer roller 125, a cleaning device for the photoconductive surface, etc., which work in cooperation to form a primary toner image on the photoconductor for subsequent transfer to the intermediate transfer belt 111 at a primary transfer nip defined between the photoconductive drum and the primary transfer roller 125.

The intermediate transfer belt 111 is trained around multiple support rollers to rotate counterclockwise in the drawing, passing through the four primary transfer nips sequentially to carry thereon a multi-color toner image toward a secondary transfer nip defined between a secondary transfer roller 121 and a belt support roller.

Below the laser exposure device 113 is a sheet conveyance mechanism 114 including one or more input sheet trays 115 each accommodating a stock of recording media such as paper sheets S and equipped with a feed roller 117. The sheet conveyance mechanism 114 also includes a pair of registration rollers 119, an output unit formed of a pair of output rollers 123, an in-body, output sheet tray 118 located underneath the image scanner 200, and other guide rollers or plates disposed between the input and output trays 115 and 118, which together define a primary, sheet conveyance path P for conveying a recording sheet S from the input tray 115, between the registration rollers 119, then through the secondary transfer nip, then through the fixing device 10, and then between the output rollers 123 to the output tray 118. A pair of secondary, sheet conveyance paths P1 and P2 are also defined in connection with the primary path P, the former for re-introducing a sheet S into the primary path P after processing through the reversal unit 300 or upon input in a manual input tray 136, and the latter for introducing a sheet S from the primary path P into the reversal unit 300 downstream from the fixing device 10.

During operation, the image forming apparatus 100 can perform printing in various print modes, including a monochrome print mode and a full-color print mode, as specified by a print job received from a user.

In full-color printing, each imaging station 112 rotates the photoconductor drum clockwise in the drawing to forward its outer, photoconductive surface to a series of electrophotographic processes, including charging, exposure, development, transfer, and cleaning, in one rotation of the photoconductor drum.

First, the photoconductive surface is uniformly charged by the charging roller and subsequently exposed to a modulated laser beam emitted from the exposure device 113. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer nip at which the incoming image is transferred to the intermediate transfer belt 111 with an electrical bias applied to the primary transfer roller 125.

As the multiple imaging stations 112 sequentially produce toner images of different colors at the four transfer nips along the belt travel path, the primary toner images are superimposed one atop another to form a single multicolor image on the moving surface of the intermediate transfer belt 111 for subsequent entry to the secondary transfer nip between the secondary transfer roller 121 and the belt support roller.

Meanwhile, the sheet conveyance mechanism 114 picks up a recording sheet S from atop the sheet stack in the sheet tray 115 to introduce it between the pair of registration rollers 119 being rotated. Upon receiving the incoming sheet S, the registration rollers 119 stop rotation to hold the sheet S therebetween, and then advance it in sync with the movement of the intermediate transfer belt 111 to the secondary transfer nip at which the multicolor image is transferred from the belt 111 to the recording sheet S with an electrical bias applied to the secondary transfer roller 121.

After secondary transfer, the recording sheet S is introduced into the fixing device 10 to fix the toner image in place under heat and pressure. The recording sheet S, thus having its first side printed, is forwarded to a sheet diverter, which directs the incoming sheet S to an output roller pair 123 for output to the in-body output tray 118 along the primary path P when simplex printing is intended, or alternatively, to the media reversal unit 300 along the secondary path P2 when duplex printing is intended.

For duplex printing, the reversal unit 300 turns over the incoming sheet S for reentry to the sheet conveyance path P along the secondary path P1, wherein the reversed sheet S again undergoes electrophotographic imaging processes including registration through the registration roller pair 119, secondary transfer through the secondary transfer nip, and fixing through the fixing device 100 to form another print on its second side opposite the first side.

Upon completion of simplex or duplex printing, the recording sheet S is output to the in-body output tray 118 for stacking inside the apparatus body, which completes one operational cycle of the image forming apparatus 100.

Figure 2:
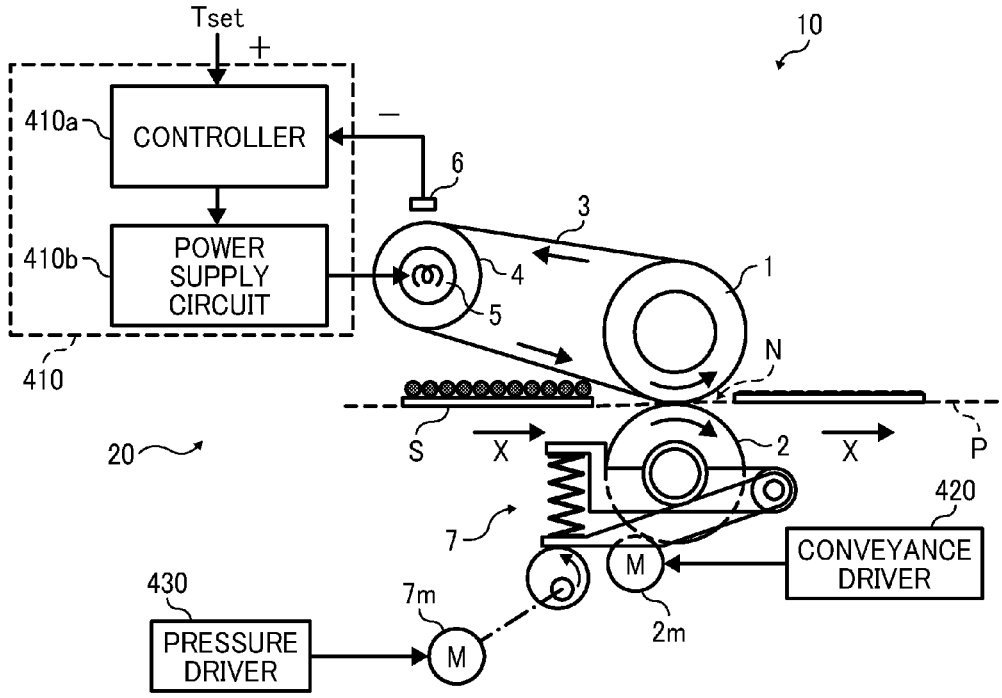
FIG. 2 is an end-on, axial cutaway view schematically illustrating a fixing device according to one or more embodiments of this patent specification.

FIG. 2 is an end-on, axial cutaway view schematically illustrating the fixing device 10 according to one or more embodiments of this patent specification.

As shown in FIG. 2, the fixing device 10 includes a main, fixing unit 20 to fix a toner image in place on a printed surface of a recording sheet S by subjecting the sheet S to a heating temperature and a pressure force during conveyance at a conveyance speed along a sheet conveyance path P.

Specifically, in the present embodiment, the fixing unit 20 comprises a belt-based assembly including a fuser roller 1; a heat roller 4 disposed parallel to the fuser roller 1; an endless, fuser belt 3 entrained around the fuser roller 1 and the heat roller 4; and a pressure roller 2 rotatably driven by a stepper motor 2*m* and disposed opposite the fuser roller 1 with the fuser belt 3 interposed between the pressure roller 2 and the fuser roller 1.

A heater 5 is disposed inside the heat roller 4 to internally heat the roller 4, from which heat is conducted to the fuser belt 3 rotating around the heated roller 4. A non-contact temperature sensor or thermometer 6 is disposed adjacent to, and out of contact with, the fuser belt 3 to detect an operational temperature of the fuser belt 3. The pressure roller 2 is equipped with a biasing mechanism 7 adjustably driven by a stepper motor 7*m*, which presses the roller 2 against the fuser roller 1 via the fuser belt 3 to form a fixing nip N therebetween.

More specifically, the fixing unit 20 also includes a heating driver 410 connected with the heater 5 to adjust the heating temperature for heating the recording sheet S; a conveyance driver 420 connected with the rotary motor 2*m* of the pressure roller 2 to adjust the conveyance speed for conveying the recording sheet S; and a pressure driver 430 connected with the adjuster motor 7*m* of the biasing mechanism 7 to adjust the pressure force for pressing the recording sheet S.

The heating driver 410 consists of a control circuit 410*a* and a power supply circuit 410*b* incorporating a pulse-width modulation (PWM) driver operatively connected to the heater 5 of the heat roller 4, so as to generate an adjustable amount of heat for heating the recording sheet S. Such driver circuitry constitutes a feedback control loop which serves to control power supply to the heater 5 of the heat roller 4 by controlling the PWM drive circuit 410*b* to adjust a duty cycle (i.e., the duration per unit of time in which a driving voltage is supplied to the heater 5) according to a differential between a specified setpoint temperature and an operational temperature detected by the thermometer 6, so that the fuser belt 3 heated by the internally heated roller 4 imparts a sufficient amount of heat to the incoming sheet S for fixing the toner image through the fixing nip N.

The heater 5 may be any suitable heat source, including electrical resistance heater, such as a halogen lamp or a ceramic heater, as well as electromagnetic induction heater (IH), which produces heat according to a duty cycle or power supply being input per unit of time.

During operation, the motor-driven pressure roller 2 rotates in a given rotational. direction (i.e., clockwise in the drawing) which in turn rotates the fuser roller 1 and the fuser belt 3 in the opposite rotational direction (i.e., counterclockwise in the drawing). The heat roller 4 is internally heated by the heater 5 to heat a length of the rotating belt 3 to a heating temperature, so as to sufficiently heat and melt toner particles through the fixing nip N.

As the rotary fixing members rotate together, a recording sheet S bearing an unfixed, powder toner image passes through the fixing nip N in a sheet conveyance direction X along the sheet conveyance path P to fix the toner image in place, wherein heat from the fuser belt 3 causes toner particles to fuse and melt, while pressure from the pressure roller 2 causes the molten toner to penetrate into the printed surface of the recording sheet S.

With the toner image thus fixed in place, the recording sheet S moves forward in the sheet conveyance direction X along the sheet conveyance path P to exit the fixing nip N. Conveyance of the recording sheet S after fixing may be accomplished, for example, by a pair of opposed, conveyance rollers disposed downstream from the fixing nip N which rotate together to move the incoming sheet S through and toward a post-fixing process.

One important factor that determines imaging quality of a fixing device is the strength of adhesion with which a fixed toner image adheres to a recording medium, i.e., the interfacial bonding strength between the toner layer and the printed surface of the recording medium. Since electrophotographic fixing proceeds where toner fuses and penetrates into a substrate with heat and pressure, the toner adhesion strength is influenced by various operational parameters with which a fixing device is operated to fix a toner image onto a recording sheet.

As used herein, the term "operational parameter" refers to a variable, adjustable factor that contributes to or defines conditions under which the fixing device is operated to fix a toner image, that is, cause fusion and penetration of toner into the printed surface of the recording sheet S. Examples of such operational parameters include, but are not limited to, a heating temperature at which the toner image is heated, a pressure applied to the recording medium during fixing, and a conveyance speed with which the recording medium is conveyed under heat and pressure.

Several methods have been proposed which adjust an operational parameter dictating a total amount of heat applied through the fixing process depending on properties of a recording medium, typically, material and thickness of paper, as specified by a user. Although effective for their intended purposes, those methods do not work for example where there are several undefined or omitted factors, such as microscopic fiber structure of the recording medium and dispersion of toner over the printed surface, that need to be addressed, but are not, to obtain good fixing performance. Not surprisingly, failure to properly adjust the operational conditions results in variations in toner adhesion strength and unstable fixing performance.

To alleviate the problem, one possible approach is to provide an allowance or extra amount of heat to be applied to the recording medium to prevent insufficient fixing of toner. Such an approach, however, can be unsatisfactory where the recording medium in use is extremely thick and requires more heat to process a toner image properly, resulting in cold offset of toner. Also, extra heat application can result in hot offset of toner as well as waste of power lost where an excessive, unnecessary amount of heat is applied to a thin recording medium that can be processed at a relatively low temperature.

The fixing device 10 according to this patent specification can optimize fixing performance according to toner adhesion strength measured by analyzing a test image fixed on a recording medium through the fixing process. Such performance optimization capability enables the fixing device 10 to process a toner image with sufficient adhesion strength to a recording medium irrespective of variations due to varying physical and dimensional properties, such as thickness and surface texture, of various types of recording media accommodated in the fixing process.

Figure 3:
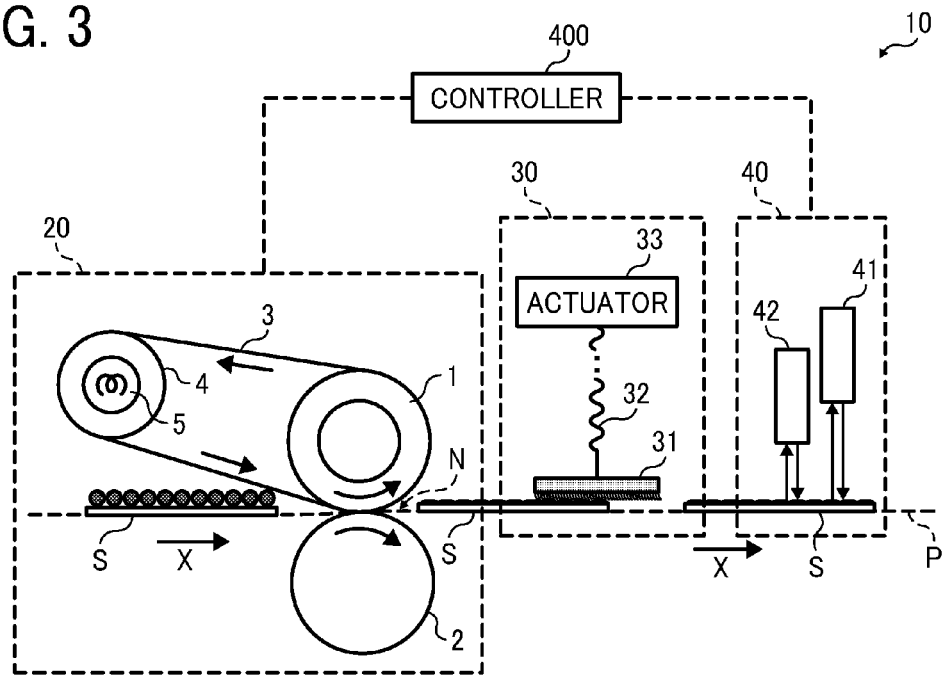
FIG. 3 is a schematic view of the fixing device of FIG. 2, provided with a shearing unit and a detection unit according to one embodiment of this patent specification.

Referring now to FIG. 3, a description is now given of the fixing device 10 with performance optimization capability according to one or more embodiments of this patent specification.

As shown in FIG. 3, the fixing device 10 includes, in addition to the main, fixing unit 20 depicted above, a post-fixing, shearing unit 30 disposed downstream from the fixing unit 20 along the sheet conveyance path P; a detection unit 40 disposed at least partially downstream from the post-fixing shearing unit 30 along the sheet conveyance path P; and a controller 400 operatively connected to the fixing unit 20 and the detection unit 40.

Figure 4:
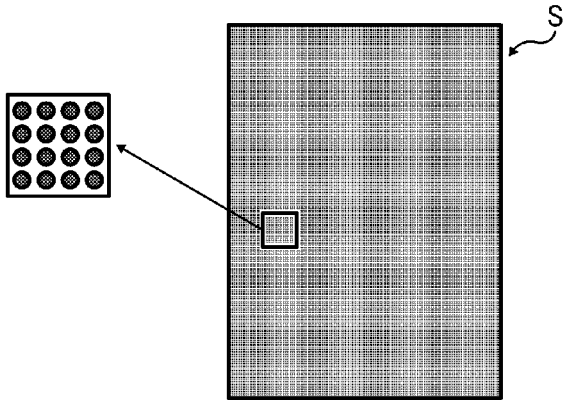
FIG. 4 illustrates an example of a test image generated for processing through the fixing device of FIG. 3.

In the fixing device 10, the controller 400 is connected with the electrophotographic imaging unit of the image forming apparatus 100, so as to direct the imaging unit to form a test image on a first surface of a recording sheet S. The test image used for the adhesion test mode may be of any suitable size and pattern, such as, for example, a continuous halftone pattern formed of multiple equally spaced dots spreading over the entire area of the printed surface, as shown in FIG. 4.

In the present embodiment, the controller 400 comprises a control system of the image forming apparatus 100 responsible for executing a sequential program which controls various pieces of electrophotographic imaging equipment to form an image on a recording sheet S. Such a control system includes, for example, a central processing unit (CPU) that controls overall operation of the apparatus, as well as its associated memory devices, such as a read-only memory (ROM) storing program codes for execution by the CPU and other types of fixed data, a random-access memory (RAM) for temporarily storing data, and a rewritable, non-volatile random-access memory (NVRAM) for storing data during power-off.

Figure 5:
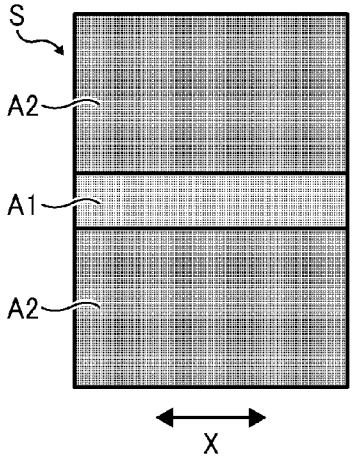
FIG. 5 illustrates an example of shorn and unshorn image areas created on a test image through the fixing device of FIG. 3.

The shearing unit 30 serves to at least partially shear toner from the toner image fixed through the fixing unit 20, so as to create a shorn image area A1 that exhibits a reduced, different image density than that of an intact, unshorn image area A2 on the printed surface of the recording sheet S, as shown in FIG. 5.

As used herein, the term "shearing" is used to describe a force applied in a direction parallel to the plane of a recording sheet S which can cause at least a portion of toner to separate from the printed surface of the recording sheet S. Such a shearing force may be established using any mechanical member, either stationary or movable, which can brush, shave, scratch, scrape, or otherwise contact the printed surface of a recording sheet S moving relative to the shearing member to create a shearing force as set forth herein.

In the present embodiment, the shearing unit 30 comprises a brush 31 loaded with a spring 32 that biases the brush 31 in a direction perpendicular to the plane of a recording sheet S conveyed along the sheet conveyance path P. The brush 31 has its bristles formed of suitable material, such as liquid crystal polymer (LCP) or the like, disposed on a substantially planar surface of a width narrower than the entire width of the test image printed on the recording sheet S. The brush 31 is provided with a computer-controlled actuator 33 which selectively moves the brush bristles into and away from contact with the recording sheet S passing through the shearing unit 30.

During operation, the recording sheet S conveyed along the sheet conveyance path P meets the bristled side of the brush 31 being elastically biased perpendicular to the plane of the recording sheet S. As the sheet S advances in the conveyance direction X, the stationary brush 31 shaves or scrapes the surface of the moving sheet S to remove at least a portion of toner once deposited and fixed upon the printed surface. Such partial removal of toner through shearing forces creates the shorn, relatively light image area A1 extending in the conveyance direction X between the unshorn, relatively dense image areas A2 on the printed surface of the recording sheet S.

In further embodiments, the shearing unit 30 may be configured and operated otherwise than that specifically depicted primarily with reference to FIG. 3. Also, the size, position, and number of shorn image area(s) on the recording sheet S may be other than that depicted in FIG. 5, depending on the configuration and operation of the shearing unit 30.

Figure 6:
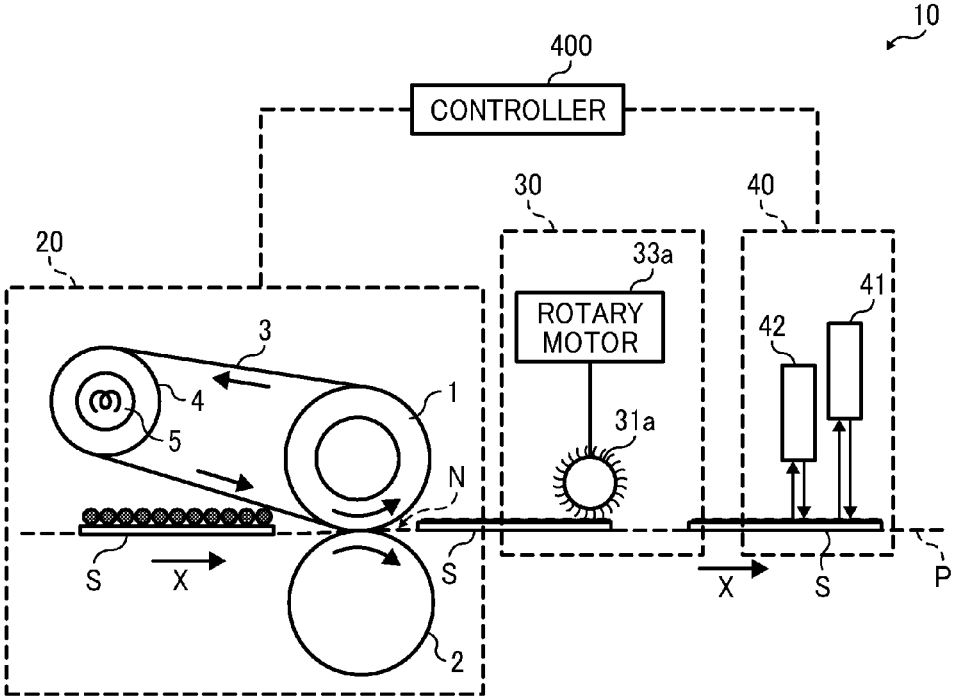
FIG. 6 is a schematic view of the fixing device of FIG. 2, provided with a shearing unit and a detection unit according to another embodiment of this patent specification.

For example, instead of a spring-loaded stationary brush, the shearing unit 30 may be formed of a brush roller 31*a* rotatably driven by a computer-controlled rotary motor 33*a* to rotate in contact with the recording sheet S conveyed along the sheet conveyance path P, as shown in FIG. 6.

Figure 7A:
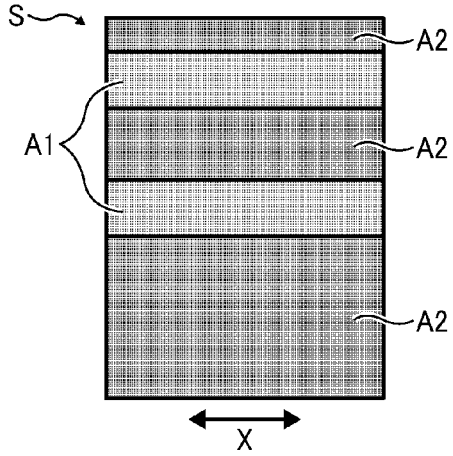
FIGS. 7A and 7B each illustrates another example of shorn and unshorn image areas created on a test image through the fixing device of FIG. 3.

Further, where the shearing unit 30 has a pair of shearing brushes arranged parallel to each other in the sheet conveyance direction X, processing the recording sheet S through the shearing unit 30 creates a pair of elongated shorn areas A1, each extending in the sheet conveyance direction X and separated from each other by an unshorn area A2 therebetween, as shown in FIG. 7A.

Figure 7B:
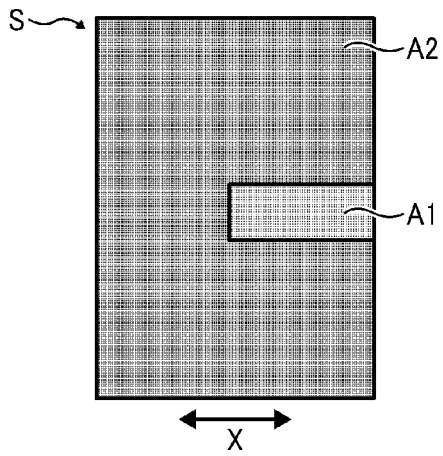

Furthermore, where the shearing member 31 is operated to move away from contact with the printed surface of the recording sheet S passing through the shearing unit 30, the resulting shorn area A1 is shorter than the entire length of the recording sheet S in the conveyance direction X, as shown in FIG. 7B.

With continued reference to FIG. 3, the detection unit 40 serves to measure the image densities of the shorn and unshorn image areas A1 and A2 of the recording sheet S created through the shearing unit 30.

In the present embodiment, the detection unit 40 includes a pair of first and second densitometers 41 and 42, the former for measuring the image density of the shorn image area A1, and the latter for measuring the image density of the unshorn image area A2, each of which is a reflection densitometer that can measure an optical density of a particular image section by measuring an intensity of light reflected from the image surface. The first and second densitometers 41 and 42 are positioned downstream from the post-fixing, shearing unit 30 along the sheet conveyance path P, while offset from each other in a direction along a width of the recording sheet S perpendicular to the sheet conveyance direction X.

During operation, the first densitometer 41 meets the shorn image area A1 and the second densitometer 42 meets the unshorn image area A2 as the recording sheet S enters the detection unit 40 downstream from the shearing unit 30 along the sheet conveyance path P. Each of the densitometers 41 and 42 is activated where the recording sheet S reaches a predetermined position along the sheet conveyance path P, so as to selectively measure an image density at a specific portions of the associated image area depending on the configuration of the shorn and unshorn image areas A1 and A2 created on the recording sheet S processed through the shearing unit 30.

Figure 8A:
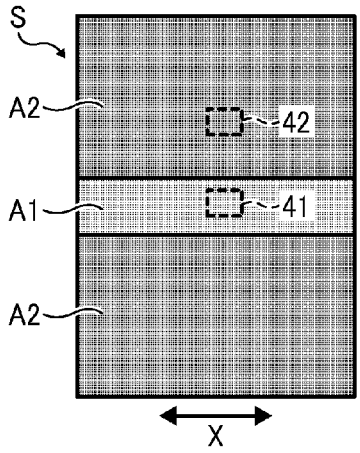
FIGS. 8A through 8D each illustrates an example of shorn and unshorn image areas subjected to image density detection through the fixing device of FIG. 3.
Figure 8B:
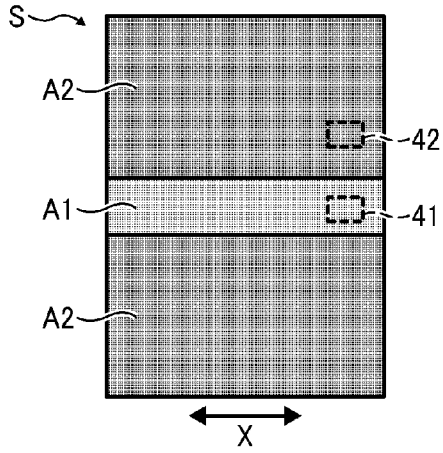
Figure 8C:
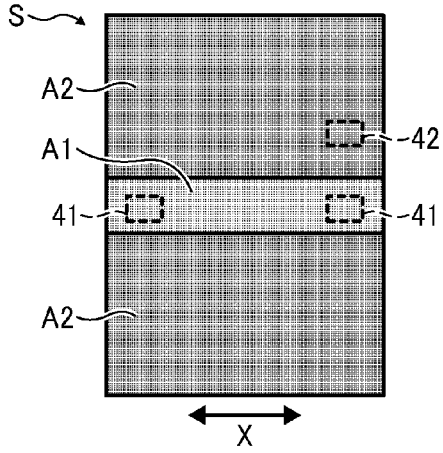

For example, where the shearing process creates an elongated shorn image area A1 extending in the sheet conveyance direction X substantially equidistant from the two side edges of the recording sheet S, each of the first and second densitometers 41 and 42 may selectively measure the image density at a specific portion of the associated image area corresponding to a mid-section of the recording sheet S, as indicated by rectangular boxes in FIG. 8A. Alternatively, instead, each of the first and second densitometers 41 and 42 may selectively measure the image density at a specific portion of the associated image area corresponding to a leading edge of the recording sheet S, as indicated by rectangular boxes in FIG. 8B. Still alternatively, instead, the first densitometer 41 may selectively measure the image density the image density at different, longitudinally spaced portions of the shorn image area A1 at least two of which correspond to leading and trailing edges of the recording sheet S, as indicated by rectangular boxes in FIG. 8C.

Figure 8D:
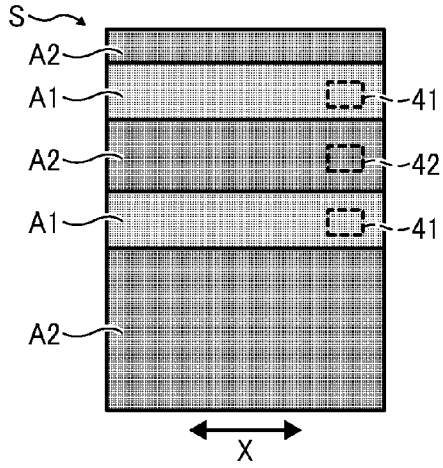

Further, where the shearing process creates a pair of elongated shorn areas A1, each extending in the sheet conveyance direction X and separated from each other by unshorn areas A2 therebetween, the first densitometer 41 may selectively measure the image density at a specific portion of each of the two shorn image areas A1 corresponding to a leading edge of the recording sheet S, as indicated by rectangular boxes in FIG. 8D.

In cases where the first densitometer 41 measures the image density at longitudinally spaced portions of the shorn image area A1, the first densitometer 41 may have multiple sensing elements aligned in series in the conveyance direction X to simultaneously measure the image density at the longitudinally spaced portions, or alternatively, a single sensing element activated at different times during conveyance of the recording sheet S in the conveyance direction X to sequentially measure the image density at the longitudinally spaced portions.

Also, in cases where the first densitometer 41 measures the image density at a specific portion of each of multiple shorn image areas A1, the first densitometer 41 may have multiple sensing elements arranged transversely across a width of the sheet conveyance path P, each of which is adapted to measure the image density of an associated one of the multiple shorn image areas A1.

In further embodiments, the detection unit 40 may be configured and operated otherwise than that specifically depicted primarily with reference to FIG. 3.

For example, although the second densitometer 42 depicted in FIG. 3 is positioned downstream from the post-fixing, shearing unit 30 along the sheet conveyance path P, alternatively, instead, the second densitometer 42 may be positioned upstream from the shearing unit 30 and downstream from the fixing unit 20 along the sheet conveyance path P to measure the image density of the unshorn image area A2 before the recording sheet S enters the shearing unit 30.

Figure 9:
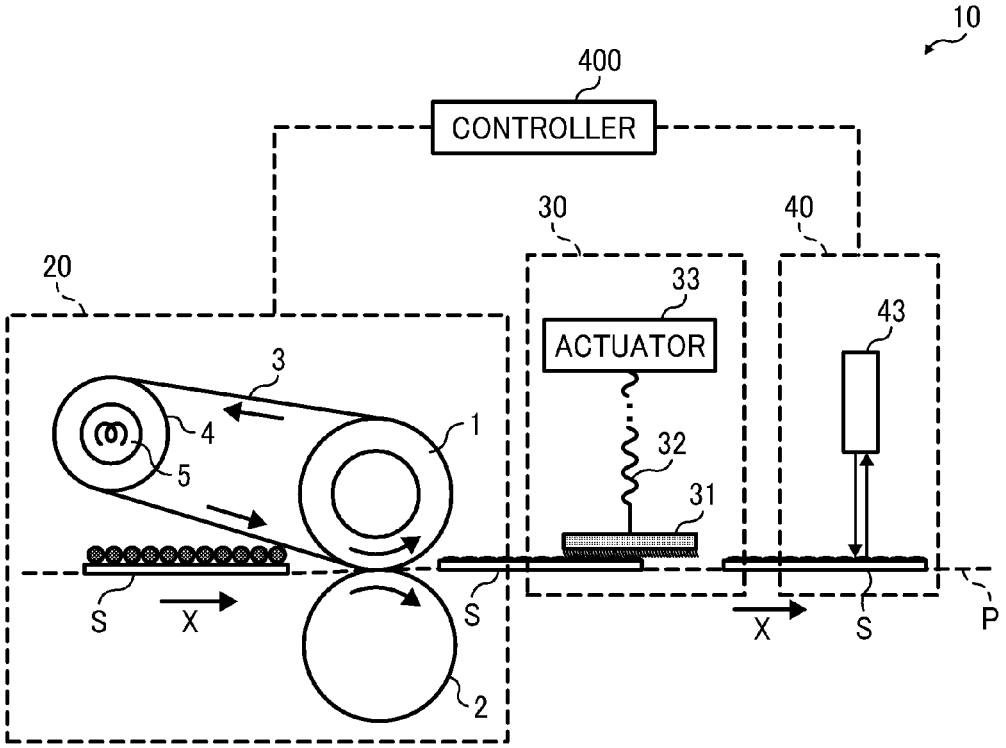
FIG. 9 is a schematic view of the fixing device of FIG. 2, provided with a shearing unit and a detection unit according to another embodiment of this patent specification.
Figure 10:
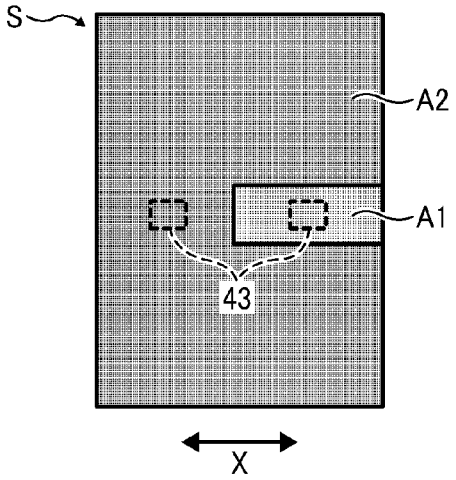
FIG. 10 illustrates an example of shorn and unshorn image areas subjected to image density detection through the fixing device of FIG. 9.

Further, although the detection unit 40 depicted in FIG. 3 has the pair of first and second densitometers 41 and 42 each dedicated to a particular image area, alternatively, instead, the detection unit 40 may be configured with a single densitometer 43 positioned downstream from the post-fixing shearing unit 30 along the sheet conveyance path P to measure the image densities of both the shorn and unshorn image areas A1 and A2, as shown FIG. 9. In such cases, the shearing process creates shorn and unshorn image areas A1 and A2 adjacent to each other in the sheet conveyance direction X, so that the densitometer 43 measures the image densities of the shorn and unshorn image areas A1 and A2 sequentially as the recording sheet S advances in the sheet conveyance direction X, as indicated by rectangular boxes in FIG. 10.

Figure 11:
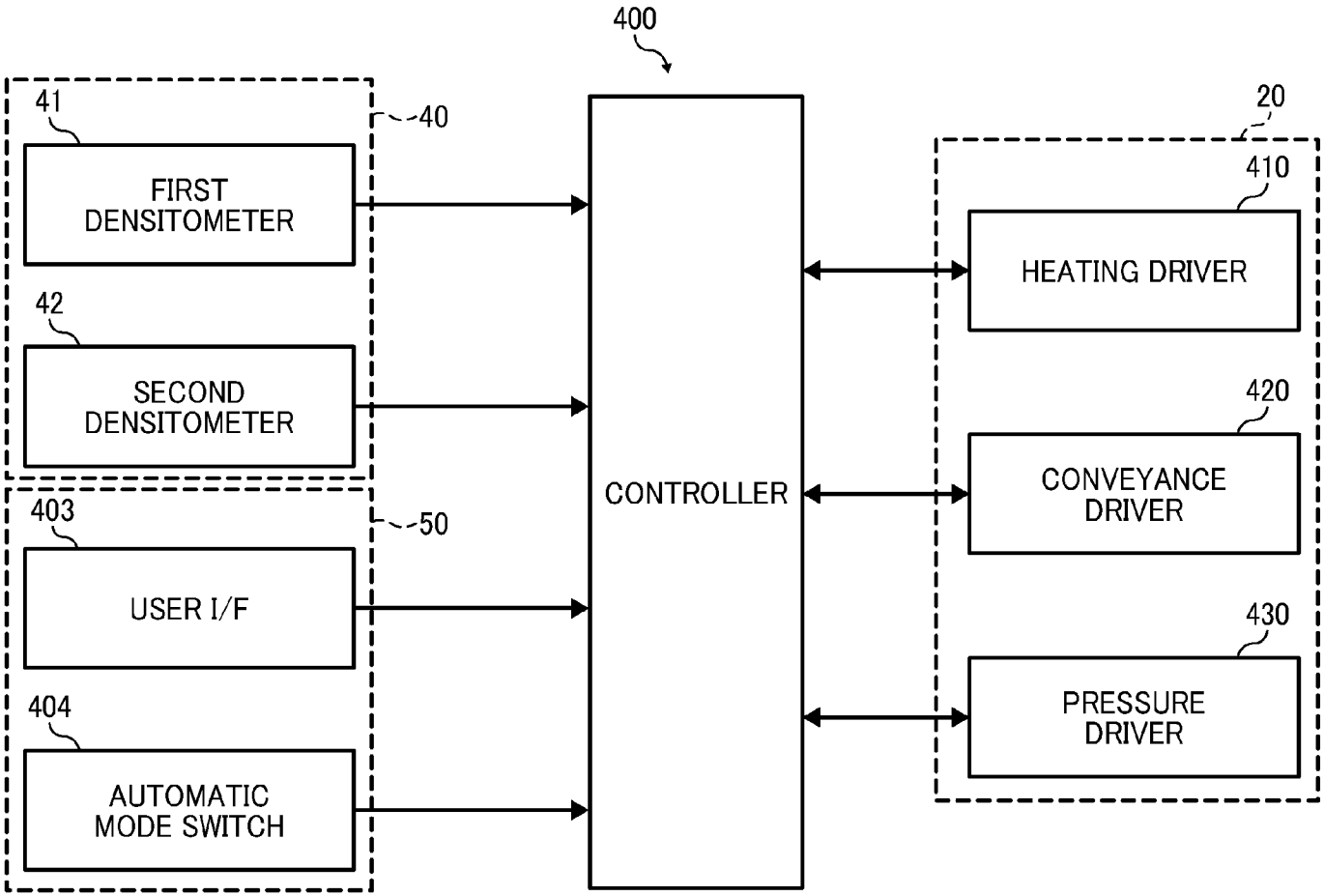
FIG. 11 is a block diagram of a controller and its associated circuitry incorporated in the fixing device of FIG. 2.

FIG. 11 is a block diagram of the controller 400 and its associated circuitry incorporated in the fixing device 10.

As shown in FIG. 11, the controller 400 is operatively connected with the first and second densitometers 41 and 42 of the detection unit 40, as well as with the heating driver 410, the conveyance driver 420, and the pressure driver 430 of the fixing unit 20.

The controller 400 serves to adjust one or more operational parameters, including at least one of the heating temperature, the pressure force, and the conveyance speed for processing the recording sheet S through the fixing unit 20, according to a difference between the measured image densities indicative of an adhesion strength of toner to the recording sheet S. Such adjustment may be accomplished, for example, by directing at least one of the heating driver 410, the conveyance driver 420, and the pressure driver 430 to adjust the one or more operational parameters to limit the image density difference to a given reference value.

Specifically, during operation, as a test image formed on a recording sheet S undergoes shearing through the shearing unit 30 to enter the detection unit 40, the first and second densitometers 41 and 42 measures image densities of the shorn and unshorn image areas A1 and A2 of the test image for transmission to the controller 400.

The controller 400 calculates a difference between the image densities transmitted from the densitometers 41 and 42, which corresponds to an amount of toner that fails to resist a shearing force through the shearing unit 30 and separates from the printed surface of the recording sheet S, and hence is assumed inversely proportional to the adhesion strength of toner to the recording sheet S. The controller 400 controls the driver circuitry to adjust at least one of the heating temperature, the pressure, and the conveyance speed so as to limit the calculated image density difference to an optimal, reference value.

For example, where the difference falls below the reference value, which indicates insufficient toner adhesion strength, the controller 400 directs the heating driver 410 to raise the heating temperature, the conveyance driver 420 to decrease the conveyance speed, and/or the pressure driver 430 to increase the pressure exerted at the fixing nip N.

Should a toner image before shearing originally exhibits a density lower than that designed for toner adhesion measurement, the image density difference may still be applied as an indicator of toner adhesion strength, allowing proper correction to the operational parameter of the fixing process. This is because the original lowness of image density in the unshorn image area is compensated for where the amount of toner shorn off from the recording medium during the shearing process is greater for a light toner image than a dense toner image.

After adjusting an operational parameter according to toner adhesion strength measured with the single test image, the fixing device 10 may subsequently execute a user-requested print job. Alternatively, for more reliable optimization of fixing performance, the fixing device 10 may repeat toner adhesion testing using multiple test images successively to ensure that adjustment of the operational parameter properly reduces the image density difference to the optimal value.

Figure 12:
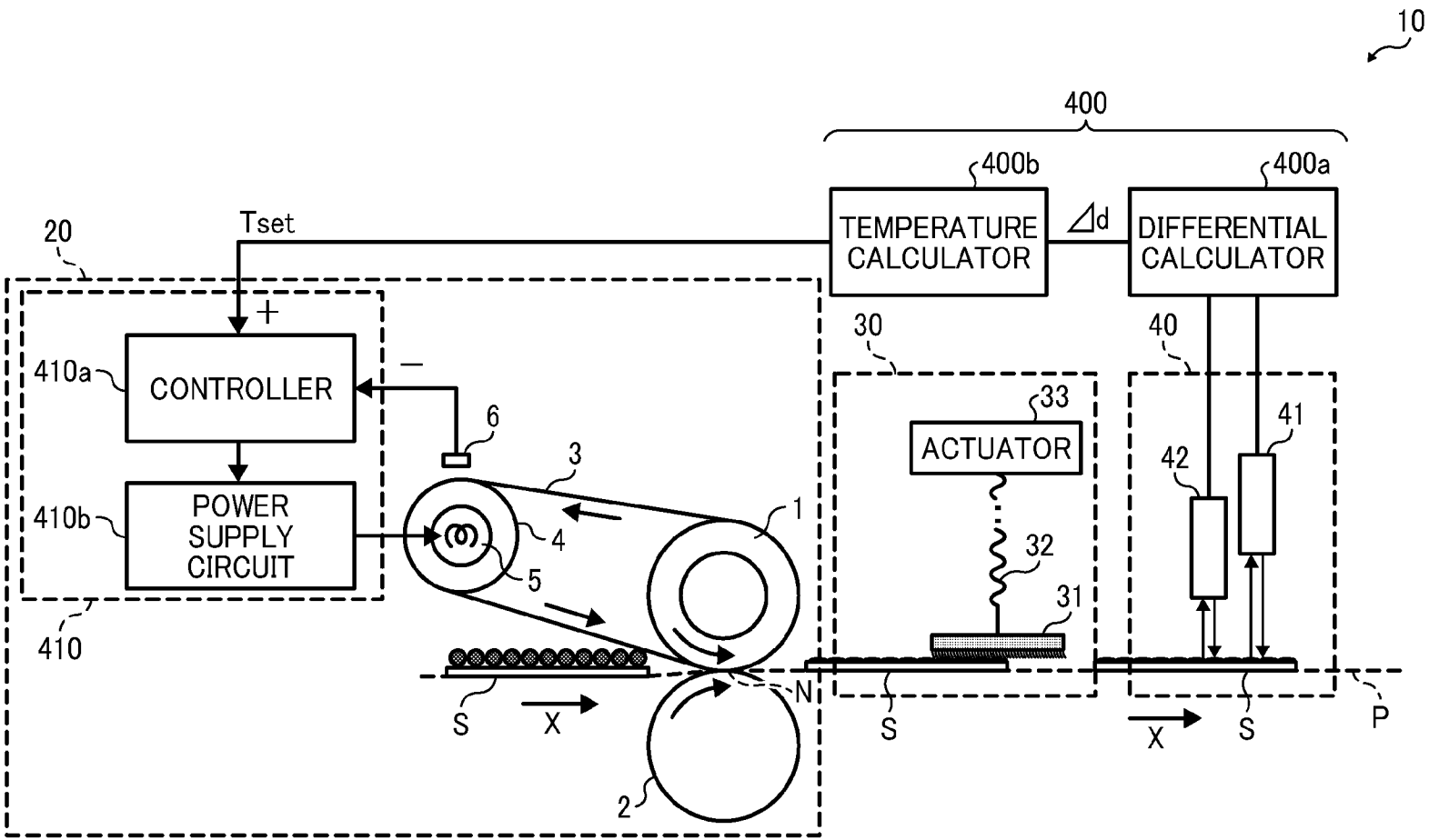
FIG. 12 is a schematic diagram of the fixing device of FIG. 2 in a configuration in which the controller adjusts a heating temperature to optimize performance of a fixing unit.

FIG. 12 is a schematic diagram of the fixing device 10 in an configuration in which the controller 400 adjusts the heating temperature to optimize performance of the fixing unit 20.

As shown in FIG. 12, the controller 400 in the present embodiment comprises a differential calculator 400*a* connected to the first and second densitometers 41 and 42, and a temperature calculator 400*b* connected between the differential calculator 400*a* and the heating driver 410 of the fixing unit 20.

The differential calculator 400*a* calculates a difference Δd between the measured image densities of the shorn and unshorn image areas A1 and A2 for transmission to the temperature calculator 400*b*. Upon receiving the image density difference Δd, indicating adhesion strength of toner to the recording sheet S, the temperature calculator 400*b* calculates an appropriate setpoint temperature Tset for heating a recording sheet S with the heater 5, which dictates a total amount of heat imparted to the recording sheet S through the fixing nip N, so as to limit the image density difference Δd to a predetermined reference value.

The setpoint temperature Tset thus obtained is transmitted to the heating control circuit 410*a*. The heating control circuit 410*a* accordingly controls the PWM drive circuit 410*b* to adjust power supply to the heater 5 based on the setpoint temperature Tset and readings of the thermometer 6 detecting the operational temperature in the fixing unit 20. Such adjustment of the heating temperature based on the measured toner adhesion strength enables the fixing unit 20 to print a toner image with desired, sufficient adhesion strength of toner to a recording sheet S when processing a subsequent print job.

Figure 13:
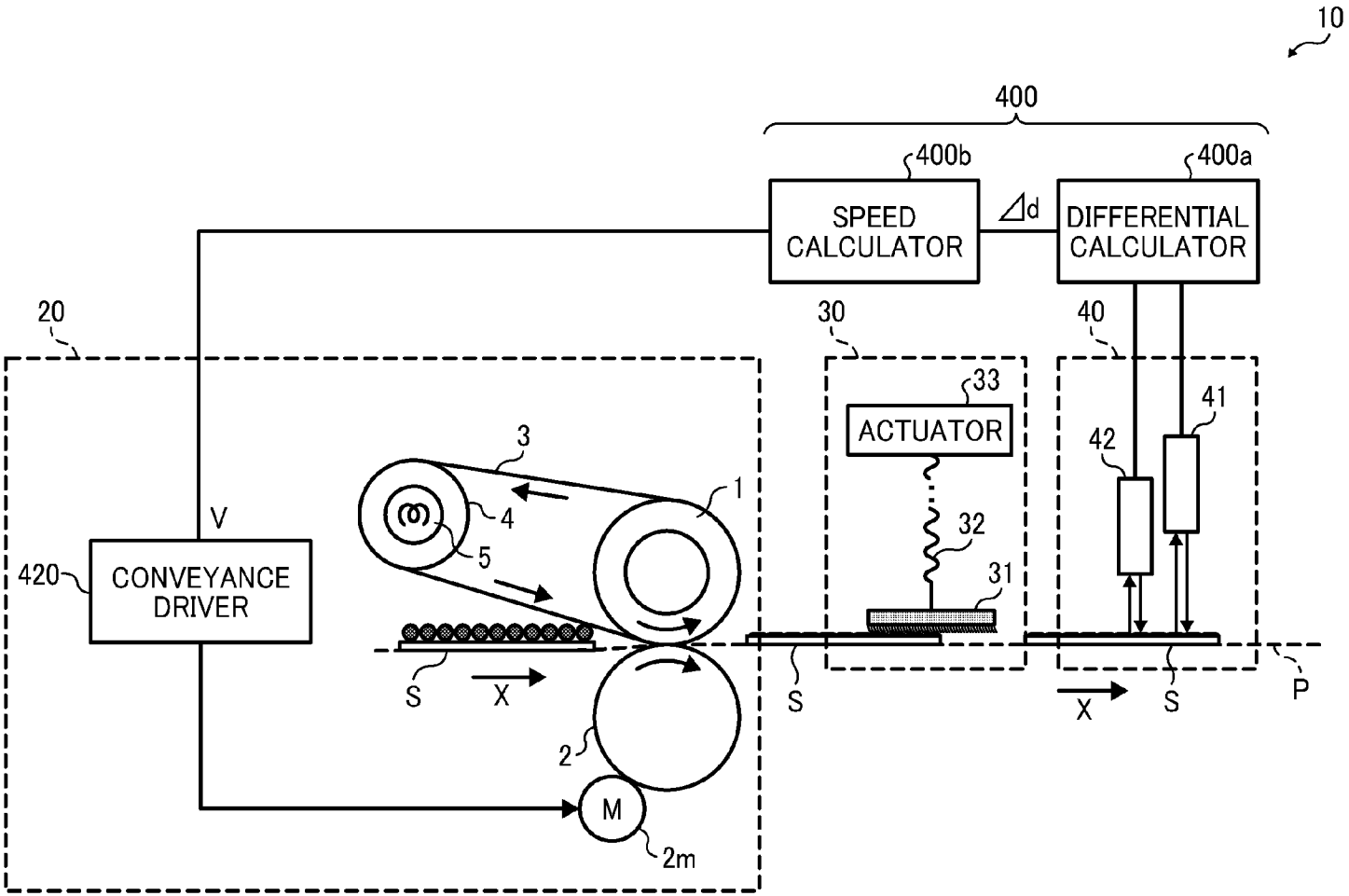
FIG. 13 is a schematic diagram of the fixing device of FIG. 2 in a configuration in which the controller adjusts a conveyance speed to optimize performance of a fixing unit.

FIG. 13 is a schematic diagram of the fixing device 10 in a configuration in which the controller 400 adjusts the conveyance speed to optimize performance of the fixing unit 20.

As shown in FIG. 13, the controller 400 in the present embodiment comprises a differential calculator 400*a* connected to the first and second densitometers 41 and 42, and a speed calculator 400*b* connected between the differential calculator 400*a* and the heating driver 410 of the fixing unit 20.

The differential calculator 400*a* calculates a difference Δd between the measured image densities of the shorn and unshorn image areas A1 and A2 for transmission to the speed calculator 400*b*. Upon receiving the image density difference Δd, the speed calculator 400*b* calculates an appropriate conveyance speed V for conveying a recording sheet S with the motor-driven fixing roller 2, which dictates a period of time during which the recording sheet S is subjected to heating, and therefore, a total amount of heat imparted to the recording sheet S through the fixing nip N, so as to limit the image density difference Δd to a predetermined reference value.

The conveyance speed V is transmitted to the conveyance driver 420. The conveyance driver 420 accordingly generates a pulse signal to adjust power supply to the stepper motor 2*m*, which then rotatably drives the pressure roller 2 with the conveyance speed V calculated by the controller 400. Such adjustment of the conveyance speed based on the measured toner adhesion strength enables the fixing unit 20 to print a toner image with a desired, sufficient adhesion strength of toner to a recording sheet S when processing a subsequent print job.

Figure 14:
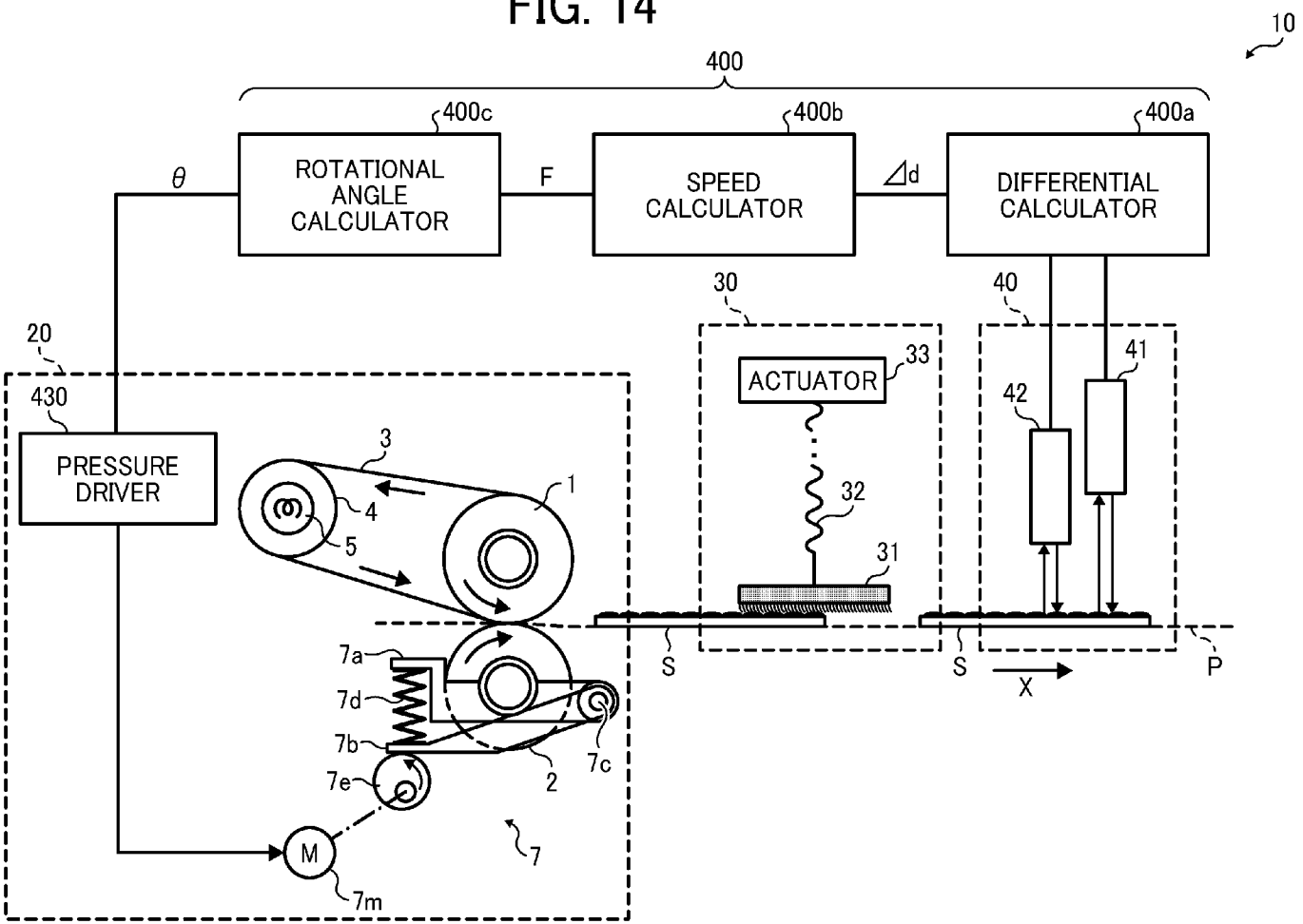
FIG. 14 is a schematic diagram of the fixing device of FIG. 2 in a configuration in which the controller adjusts a pressure force to optimize performance of a fixing unit.

FIG. 14 is a schematic diagram of the fixing device 10 in a configuration in which the controller 400 adjusts the pressure force to optimize performance of the fixing unit 20.

As shown in FIG. 14, the controller 400 in the present embodiment comprises a differential calculator 400*a* connected to the first and second densitometers 41 and 42, a pressure calculator 400*b* and a rotational angle calculator 400*c* connected in series between the differential calculator 400*a* and the pressure driver 430 of the fixing unit 20.

In the fixing unit 20, the biasing mechanism 7 includes a pair of first and second levers 7*a* and 7*b* hinged together along a pivot axis 7*c*, with a compression coil spring 7*d* disposed between free, distal ends of the hinged levers 7*a* and 7*b*. The first lever 7*a* engages a rotational shaft of the pressure roller 2, whereas the second lever 7*b* is rotatable relative to the first lever 7*a* around the common pivot axis 7*c*. An eccentric cam 7*e* is held against the free end of the second lever 7*b* to adjust energy stored in the coil spring 7*d*, while connected to the stepper motor 7*m* which rotates the cam 7*e* by a variable angle of rotation adjusted by the pressure driver 430.

The differential calculator 400*a* calculates a difference Δd between the measured image densities of the shorn and unshorn image areas A1 and A2 for transmission to the pressure calculator 400*b*. Upon receiving the image density difference Δd, the pressure calculator 400*b* calculates an appropriate pressure force F for pressing a recording sheet S with the biasing mechanism 7, which dictates a period of time during which the recording sheet S is subjected to heating, and therefore, a total amount of heat imparted to the recording sheet S through the fixing nip N, so as to limit the image density difference Δd to a predetermined reference value.

The pressure force F is converted to a proportional rotational angle θ through the rotational angle calculator 400*c* for subsequent transmission to the pressure driver 430. The pressure driver 430 accordingly generates a pulse signal to adjust power supply to the pressure drive motor 7*m*, which then rotates the eccentric cam 7*e* by the rotational angle θ calculated by the controller 400. Such adjustment of the pressure force based on the measured toner adhesion strength enables the fixing unit 20 to print a toner image with a desired, sufficient adhesion strength of toner to a recording sheet S when processing a subsequent print job.

Referring back to FIG. 11, the controller 400 is shown further provided with an operational mode selector 50, including a user interface 403 and an automatic mode switch 404, which allows the fixing device 10 to selectively operate in a normal, imaging mode in which printing is performed to execute a user-submitted print job, and an occasional, test mode in which fixing is followed by shearing, density measurement, and operational parameter adjustment to control the adhesion strength of toner to the recording sheet S.

Specifically, in the present embodiment, the user interface 403 comprises a control panel with user-operable keys provided on the image forming apparatus 100 which allows a user to submit a mode selection signal for switching the operational mode between the imaging mode and the test mode.

Provision of the user interface 403 allows the user to set up the fixing device 10 in the test mode to adjust operational conditions where he or she attempts to confirm printer functionality by running a test print, for example, upon initial activation after an extended period of inactivity.

The automatic mode switch 404 comprises a motion detector disposed on an inner enclosure wall facing an openable cover of the image forming apparatus 100 to detect movement of the user-accessible container or tray 115 of recording sheets S to submit a mode selection signal which causes the controller 400 to switch the operational mode from the imaging mode to the test mode upon detection of movement of the sheet tray 115.

Provision of the automatic mode switch 404 allows the fixing device 10 to operate in the test mode to adjust operational parameters upon detection of movement of the input sheet tray 115, which indicates a possible change in the type of recording sheet S used for printing, so as to accommodate variations, if any, in the operational conditions caused during operation of the image forming apparatus. The controller 400 may change the operation mode from the imaging mode to the test mode, regardless of whether the type of recording sheets S has actually been changed.

In the present embodiment, the operational mode selector 50 may switch the operational mode during duplex printing of a single recording sheet S that has a first surface thereof printed initially and a second surface thereof printed subsequently, so that the fixing device processes the first printed surface in the test mode and the second printed surface in the imaging mode. In such cases, the user interface 403 may allow a user to determine whether or not to perform duplex printing on a recording sheet S used to print a test image in the test mode.

Where the fixing device 10 processes the first and second surfaces of a single recording sheet S in the test mode and the imaging mode, respectively, the controller 400 modifies one or more operational parameters during printing on the second printed surface so as to compensate for an amount of heat accumulated in the recording sheet S during printing on the first printed surface.

Such modification is accomplished, for example, based on a predefined lookup table that maps the amount of heat dissipated from a recording sheet S during a specific period of time elapsed since completion of processing on the first printed surface. Using the lookup table, the controller 400 modifies one or more operational parameters to reduce an amount of heat applied to the recording sheet S through the fixing process to a level inversely proportional to a period of time from when printing on the first surface is completed to when printing on the second surface is initiated. The reduction in the amount of heat applied takes place only temporarily, so that the fixing device 10 operates in the imaging mode without further modifying the operational parameters adjusted according to the measured toner adhesion strength, where printing is performed on a recording sheet S that has cooled sufficiently after printing on the first surface, or a new recording sheet that has not been used for printing.

Further, the controller 400 may adjust operational parameters not only during operation in the test mode, but also during operation in the imaging mode where a user changes a level of gloss of an image to be printed.

Such arrangement allows the fixing device 10 to adjust the operational parameters in response to the user-specified change to the image gloss, which is determined by a glass transition temperature of toner being used, and therefore involves a corresponding change in operational conditions determining an amount of heat applied to a recording sheet S during printing.

Figure 15:
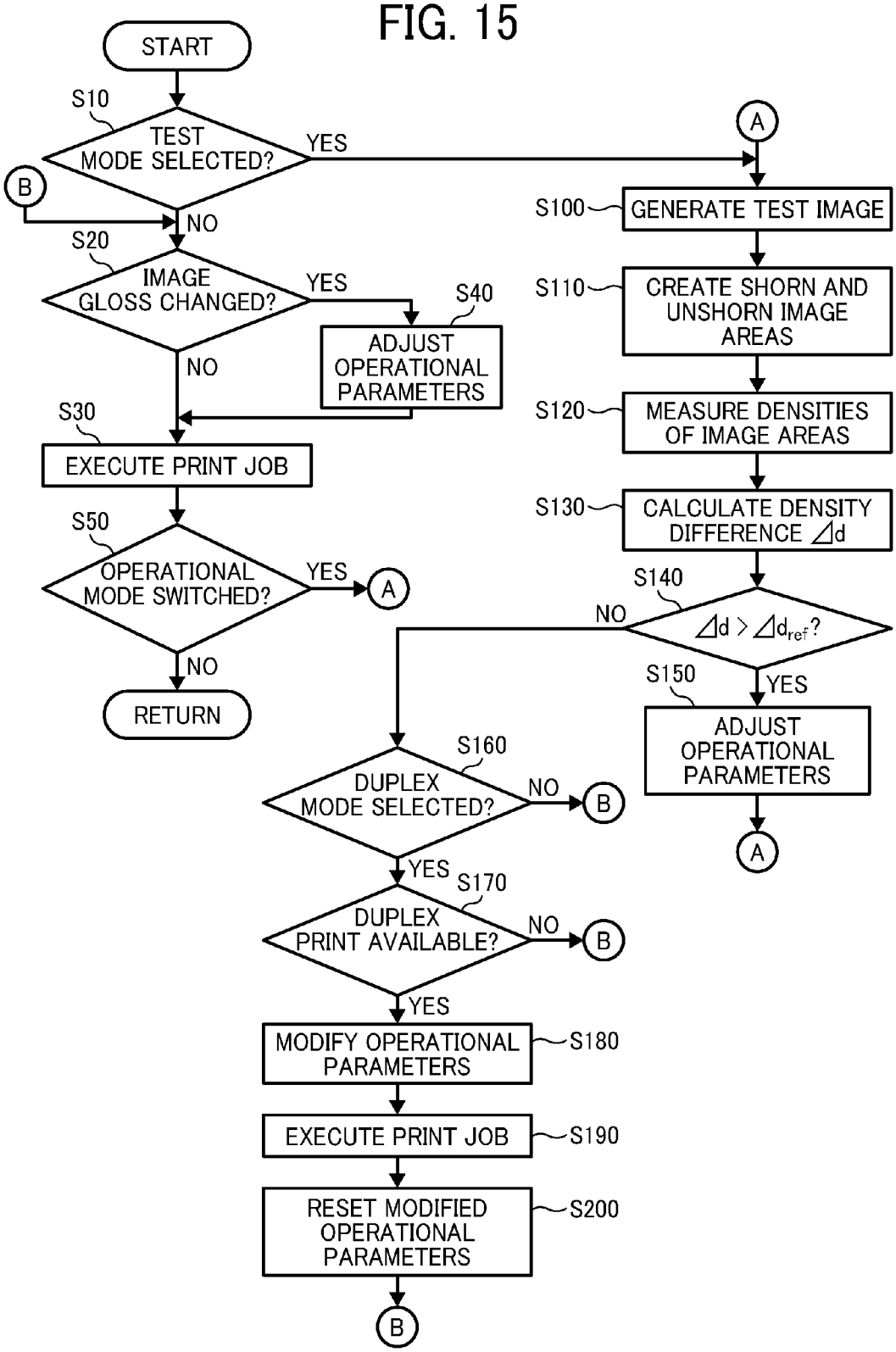
FIG. 15 is a flowchart illustrating an operation of the controller incorporated in the fixing device according to one or more embodiments of this patent specification.

FIG. 15 is a flowchart illustrating an operation of the controller 400 incorporated in the fixing device 10 according to one or more embodiments of this patent specification.

As shown in FIG. 15, the controller 400 initially accesses the operational mode indicator 50 to determine which operational mode of the fixing device 10 is selected through the user interface 403 (step S10).

Where the fixing device 10 is in the imaging mode ("NO" in step S10), the controller 400 then determines whether a user changes a level of gloss of an image to be printed (step S20).

Where there is no change in the user-specified level of image gloss ("NO" in step S20), the controller 400 executes a user-submitted print job in the normal, imaging mode (step S30).

Where there is a change in the user-specified level of image gloss ("YES" in step S20), the controller 400 adjusts one or more operational parameters including at least one of the heating temperature, the pressure force, and the conveyance speed for processing the recording sheet S through the fixing unit 20 (step S40). Thereafter, the operation proceeds to step S30.

After printing in the imaging mode, the controller 400 accesses the operational mode selector 50 to determine whether the automatic mode switch 404 detects movement of the sheet tray 115 (step S50).

Where there is no mode selection signal indicative of movement of the sheet tray 115 ("NO" in step S50), the operation returns to step S10.

Where the fixing device 10 is in the test mode ("NO" in step S10), or where the operational mode selector 50 signals detection of movement of the sheet tray 115 ("YES" in step S50), the controller 400 directs the imaging unit of the image forming apparatus 100 to generate a test image on a first surface of a recording sheet S (step S100).

As the test image undergoes fixing through the fixing unit 20, the controller 400 directs the post-fixing shearing unit 30 to create shorn and unshorn areas A1 and A2 in the fixed test image (step S110), followed by the detection unit 40 measuring image densities of the shorn and unshorn image areas A1 and A2 (step S120).

Upon receiving the image densities from the detection unit 40, the controller 400 then calculates a difference Δd between the detected image densities of the shorn and unshorn image areas A1 and A2 (step S130), and then compares the calculated difference Δd against a predetermined reference value $\Delta d_{ref}$ (step S140).

Where the difference Δd exceeds the reference $\Delta d_{ref}$ ("YES" in step S140), the controller 400 directs driver circuitry to adjust one or more operational parameters, including at least one of the heating temperature, the pressure force, and the conveyance speed, for processing the recording sheet S through the fixing unit, so as to reduce the image density difference Δd to the reference value $\Delta d_{ref}$ (step S150). Thereafter, the operation returns to step S100.

Where the difference Δd falls below the reference $\Delta d_{ref}$ ("NO" in step S150), the controller 400 then determines which printing mode is selected to operate the image forming apparatus 100 (step S160).

Where the image forming apparatus 100 is in the simplex mode ("NO" in step S160), the operation returns to step S20.

Where the image forming apparatus 100 is in the duplex mode ("YES" in step S160), the controller 400 accesses the operational mode selector 50 to determine whether or not to perform duplex printing on the recording sheet S used to print the test image in the test mode (step S170).

Where duplex printing on the recording sheet S is unavailable ("NO" in step S170), the operation returns to step S20.

Where duplex printing on the recording sheet S is available ("YES" in step S170), the controller 400 temporarily modifies one or more operational parameters to compensate for an amount of heat accumulated in the recording sheet S during printing on the first printed surface (step S180), and executes a user-submitted print job under the modified operational conditions (step S190), followed by resetting the operational parameters to their unmodified state as they were adjusted based on the image density difference Δd (step S200). Thereafter, the operation returns to step S20.

Hence, the fixing device 10 according to this patent specification can optimize fixing performance according to toner adhesion strength measured by analyzing a test image fixed on a recording medium S through the fixing unit 20, wherein the shearing unit 30 creates a shorn image area A1 and an intact, unshorn image area A2 on the printed surface of the recording medium S; the detection unit 40 measure the image densities of the shorn and unshorn image areas A1 and A2; and the controller 400 adjusts one or more operational parameters, including at least one of the heating temperature, the pressure force, and the conveyance speed, for processing the recording sheet S through the fixing unit 20 according to a difference between the measured image densities of the shorn and unshorn image areas A1 and A2 indicative of an adhesion strength of toner to the recording medium S.

Such performance optimization capability based on measurement of toner adhesion strength enables the fixing device 10 to process a toner image with good adhesion strength to a recording medium irrespective of variations due to varying physical and dimensional properties, such as thickness and surface texture, of various types of recording media S accommodated in the fixing process.

Compared to adjusting operational conditions according to properties of recording medium derived through detection or from user specification, adjusting the operational parameters according to measured toner adhesion strength can reliably control fixing performance without the risk of overheating a recording medium and a concomitant loss of power consumed in the fixing process.

Although specific embodiments have been illustrated and described herein, any arrangement calculated to achieve the same purpose may be substituted for the specific embodiments shown. Thus, the fixing device according to this patent specification is applicable to any type of fixing process that fixes a toner image in place on a printed surface of a recording sheet S by subjecting the sheet S to a heating temperature and a pressure during conveyance at a conveyance speed along a media conveyance path. For example, the fixing device may employ a roller-based assembly, instead of a belt-based assembly, in which an internally heated roller is paired with an elastically biased roller to form a fixing nip therebetween.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a fixing unit to fix a toner image in place on a printed surface of a recording medium by subjecting the medium to a heating temperature and a pressure force during conveyance at a conveyance speed along a media conveyance path;

a shearing unit disposed downstream from the fixing unit along the media conveyance path to at least partially shear toner from the fixed toner image, so as to create a shorn image area that exhibits a different image density than that of an intact, unshorn image area on the printed surface of the recording medium;

a detection unit disposed at least partially downstream from the shearing unit along the media conveyance path to measure the image densities of the shorn and unshorn image areas; and a controller operatively connected to the fixing unit and the detection unit to adjust one or more operational parameters, including at least one of the heating temperature, the pressure force, and the conveyance speed for processing the recording medium through the fixing unit, according to a difference between the measured image densities indicative of an adhesion strength of toner to the recording medium.

2. The fixing device according to claim 1, wherein the fixing unit includes:

a heating driver to adjust the heating temperature for heating the recording medium;

a pressure driver to adjust the pressure force for pressing the recording medium; and a conveyance driver to adjust the conveyance speed for conveying the recording medium, the controller directs at least one of the heating driver, the pressure driver, and the conveyance driver to adjust the one or more operational parameters to limit the image density difference to a given reference value.

3. The fixing device according to claim 1, wherein the detection unit comprises:

a first densitometer positioned downstream from the shearing unit along the media conveyance path to measure the image density of the shorn image area; and a second densitometer positioned downstream from the fixing unit along the media conveyance path to measure the image density of the unshorn image area.

4. The fixing device according to claim 3, wherein the second densitometer is positioned upstream from the shearing unit along the media conveyance path to measure the image density of the unshorn image area before the recording medium enters the shearing unit.

5. The fixing device according to claim 3, wherein the second densitometer is positioned downstream from the shearing unit along the media conveyance path to measure the image density of the unshorn image area after the recording medium enters the shearing unit.

6. The fixing device according to claim 3, wherein the shearing unit creates an elongated, shorn image area which extends in a media conveyance direction in which the recording medium is conveyed along the media conveyance path, the first densitometer selectively measures the image density at a specific portion of the shorn image area corresponding to a leading edge of the recording medium.

7. The fixing device according to claim 3, wherein the shearing unit creates an elongated, shorn image area which extends in a media conveyance direction in which the recording medium is conveyed along the media conveyance path, the first densitometer selectively measures the image density at different, longitudinally spaced portions of the shorn image area at least two of which correspond to leading and trailing edges of the recording medium.

8. The fixing device according to claim 7, wherein the first densitometer comprises multiple sensing elements aligned in series in the media conveyance direction to simultaneously measure the image density at the longitudinally spaced portions of the shorn image area.

9. The fixing device according to claim 7, wherein the first densitometer comprises a sensing element activated at different times during conveyance of the recording medium in the media conveyance direction to sequentially measure the image density at the longitudinally spaced portions of the shorn image area.

10. The fixing device according to claim 3, wherein the shearing unit creates multiple, parallel shorn image areas each of which extends in a media conveyance direction in which the recording medium is conveyed along the media conveyance path, the first densitometer includes multiple sensing elements arranged transversely across a width of the media conveyance path, each of which is adapted to measure the image density of an associated one of the multiple shorn image areas.

11. The fixing device according to claim 1, wherein the shearing unit creates shorn and unshorn image areas adjacent to each other in a media conveyance direction in which the recording medium is conveyed along the media conveyance path, the detection unit comprises a densitometer positioned downstream from the shearing unit along the media conveyance path to measure the image densities of the shorn and unshorn image areas sequentially as the recording medium advances in the media conveyance direction from the shearing unit.

12. The fixing device according to claim 1, wherein the shearing unit comprises:

an elastically biased brush; and an actuator to selectively move the brush into and away from contact with the recording medium conveyed along the media conveyance path.

13. The fixing device according to claim 1, further comprising:

an operational mode selector connected to the controller to allow the fixing device to selectively operate in an imaging mode in which printing is performed to execute a user-submitted print job, and a test mode in which fixing is followed by shearing, density measurement, and operational parameter adjustment to control the adhesion strength of toner to the recording medium.

14. The fixing device according to claim 13, wherein the operational mode selector includes an automatic mode switch that detects movement of a user-accessible container of recording media to cause the controller to switch the operational mode from the imaging mode to the test mode upon detection of movement of the media container.

15. The fixing device according to claim 13, wherein the operational mode selector includes a user interface that allows a user to switch the operational mode between the imaging mode and the test mode.

16. The fixing device according to claim 13, wherein the operational mode selector switches the operational mode during duplex printing of a single recording medium that has a first surface thereof printed initially and a second surface thereof printed subsequently, so that the fixing device processes the first printed surface in the test mode and the second printed surface in the imaging mode.

17. The fixing device according to claim 16, wherein the controller temporarily modifies the one or more operational parameters during printing on the second printed surface according to an amount of heat accumulated in the recording medium during printing on the first printed surface.

18. The fixing device according to claim 1, wherein the controller adjusts the one or more operational parameters during operation in the imaging mode where a user changes a level of gloss of an image to be printed.

19. A method for controlling a fixing device that fixes a toner image in place on a printed surface of a recording medium by subjecting the medium to a heating temperature and a pressure during conveyance at a conveyance speed, the method comprising:

at least partially shearing toner from the fixed toner image, so as to create a shorn image area that exhibits a reduced, different image density than that of an intact, unshorn image area on the printed surface of the recording medium;

measuring the image densities of the shorn and unshorn image areas; and adjusting one or more operational parameters including at least one of the heating temperature, the pressure, and the conveyance speed for processing the recording medium through the fixing unit according to a difference between the measured image densities indicative of an adhesion strength of toner to the recording medium.

20. An image forming apparatus, comprising:

an imaging unit to form a toner image on a printed surface of a recording medium;

a fixing unit to fix the toner image in place on the printed surface of the recording medium by subjecting the medium to a heating temperature and a pressure force during conveyance at a conveyance speed along a media conveyance path;

a shearing unit disposed downstream from the fixing unit along the media conveyance path to at least partially shear toner from the fixed toner image, so as to create a shorn image area that exhibits a different image density than that of an intact, unshorn image area on the printed surface of the recording medium;

a detection unit disposed at least partially downstream from the shearing unit along the media conveyance path to measure the image densities of the shorn and unshorn image areas; and a controller operatively connected to the fixing unit and the detection unit to adjust one or more operational parameters, including at least one of the heating temperature, the pressure force, and the conveyance speed for processing the recording medium through the fixing unit, according to a difference between the measured image densities indicative of an adhesion strength of toner to the recording medium.

* * * * *